United States Patent [19]

Grunwald

[11] Patent Number: 4,650,314

[45] Date of Patent: Mar. 17, 1987

[54] FILM INSPECTION MACHINE

[76] Inventor: Robert F. Grunwald, 1304 Elm Tree Rd., Lake Forest, Ill. 60045

[21] Appl. No.: 539,917

[22] Filed: Oct. 7, 1983

[51] Int. Cl.[4] ..... G03C 11/02; G08B 1/08

[52] U.S. Cl. ..... 355/40; 226/45; 242/67.2; 328/5; 361/181

[58] Field of Search ..... 200/DIG. 1, DIG. 8; 318/16, 662; 455/66, 67, 347; 340/568; 352/129; 355/40; 226/45

[56] References Cited

U.S. PATENT DOCUMENTS

| | | | |
|---|---|---|---|
| 2,312,835 | 3/1943 | Hansell | 455/66 X |
| 2,896,196 | 7/1959 | Hartford et al. | 73/159 X |
| 2,919,624 | 1/1960 | Lindeman | 73/159 UX |
| 3,532,990 | 10/1970 | Kasper | 328/5 |
| 3,725,808 | 4/1973 | Oushige et al. | 361/181 X |
| 3,970,911 | 7/1976 | Schmall | 318/662 X |
| 4,175,239 | 11/1979 | Sandler | 361/181 X |
| 4,400,758 | 8/1983 | Frame | 200/DIG. 1 X |

OTHER PUBLICATIONS

"Sourcebook of Electric Circuits", McGraw-Hill Book Co., 1968 (John Markus) pp. 67, 68.

*Primary Examiner*—Daniel M. Yasich

*Attorney, Agent, or Firm*—McCaleb, Lucas & Brugman

[57] ABSTRACT

A film or photo print inspection machine having a print-advancing drive means to run a strip or web of photo prints from at least one supply reel to a corresponding collecting reel, over a viewing surface, is provided with a presence switch means activated by a capacitance reactive sensor or sensing antenna, the antenna being comprised of a metal plate mounted on the rear of the viewing surface such that introduction of an operating technician's hand, or other impedance, into a sensing region established by the antenna, in order to mark a defective photographic print, will activate the presence switch means to turn off the print-advancing drive means. Print advancement resumes when the technician's hand, or other object, is withdrawn from the antenna sensing region.

2 Claims, 5 Drawing Figures

FILM INSPECTION MACHINE

BACKGROUND OF THE INVENTION

1. Field of the Invention

This invention relates generally to machines for inspecting web-like materials and more specifically to a motor-driven apparatus for serially advancing a continuous strip of developed photographic prints over an inspection surface from at least one supply reel to a corresponding collecting reel, such that an operator can conveniently identify and mark defective photographs.

2. Description of the Prior Art

An important quality-control step in the large scale laboratory processing of photographic film is the inspection of developed photographs in the form of continuous, reel-wound strips to assure that any pictures which are objectionable, for example, those which are marred by color imperfections and dirt, etc., or photographs containing illegal content, are not inadvertently transmitted to the customer. However, given the enormous quantity of film being processed in major labs, the task of quality-control is tedious and time consuming, a problem which markedly reduces the level of defect discernment by film inspecting personnel.

Film print inspection, for many years, has been facilitated by machines similar to that disclosed herein inasmuch as uncut strips of developed photographs are advanced by a drive means from supply reels to collecting reels across a viewing surface. Such automation, nevertheless, involves problems which have detracted from the expected output of automation assisted film inspection in terms of the quantity of accurately inspected film per unit of time.

One particular problem encountered in the art of automated film print inspection under present practice is the physically minor, yet nonetheless time-consuming and repetitive activity required of the inspecting technician in having to halt the print strip for inspection when a defective print is discovered, and then restart it after the print has been marked. Manual intervention of the operator, as such, by operating a foot or hand switch substantially detracts from the smoothness and efficiency of the print inspection task, thereby reducing the quantity of photographic prints which can be processed accurately in a given period of time.

SUMMARY OF THE INVENTION

The present invention represents a significant advance in print inspection technology from the standpoint of maximizing the output of inspecting personnel by minimizing their physical participation in the actual operation of the inspecting machines while the print web is being inspected. This object is achieved by an improvement upon presently available inspection machines, namely, the addition of a presence switch means which is activated by a capacitance reactive sensor or sensing antenna, the antenna being located preferably adjacent to the print inspection surface of the machine, such that introduction of an operating technician's hand (and marking pen) into the sensing region established by the antenna, for the purpose of marking a defective print, will conveniently halt the print advancing drive means and momentarily cause the film prints to stop moving over the film inspection surface until the operator's hand is withdrawn beyond the sensing region, at which time print movement is promptly restored.

IN THE DRAWINGS

DESCRIPTION OF THE PREFERRED EMBODIMENT

A preferred embodiment of the invention is shown in FIGS. 1–4 as comprising a vertical-running print inspection machine 10 having an inclined planar panel 11 defining a viewing and marking area or surface over which a strip (or strips) 12 of developed photographic prints or similar web-like material may be advanced by motor-driven capstan means 13 located at the upper end of the machine.

Figure 3:
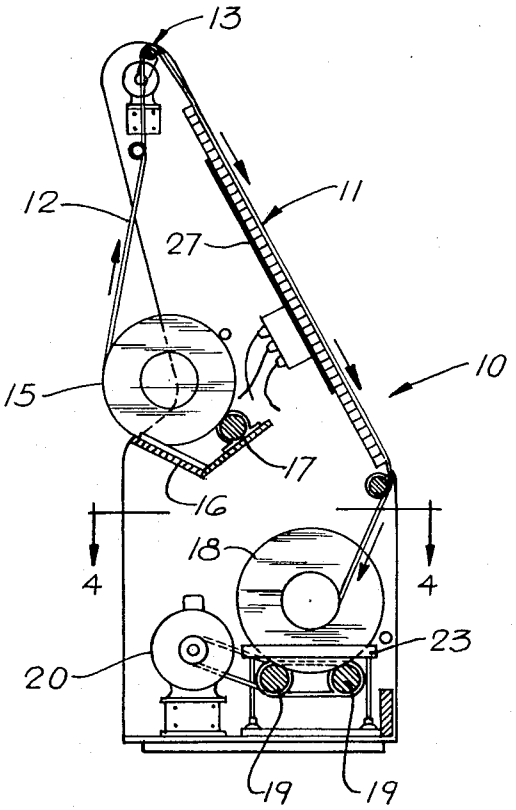
FIG. 3 is a vertical cross-sectional view of the machine shown in FIGS. 1 and 2.

As shown best in FIG. 3 each photo strip 12 is advanced from its supply reel 15 which rests in a V-shaped shelf 16 and rides freely upon plastic roller 17 as the strip is dispensed upwardly from reel 15 over the rotatably driven capstan means 13 and downwardly over the front viewing surface of panel 11.

Figure 2:
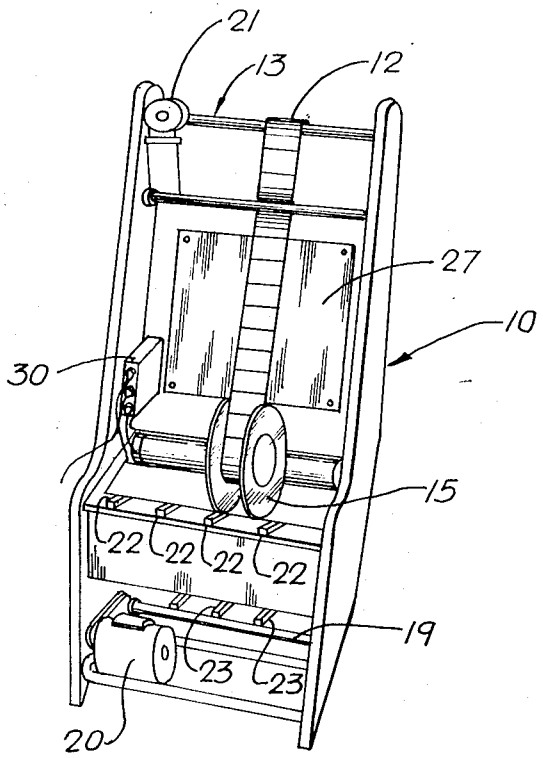
FIG. 2 is a rear perspective view thereof.
Figure 1:
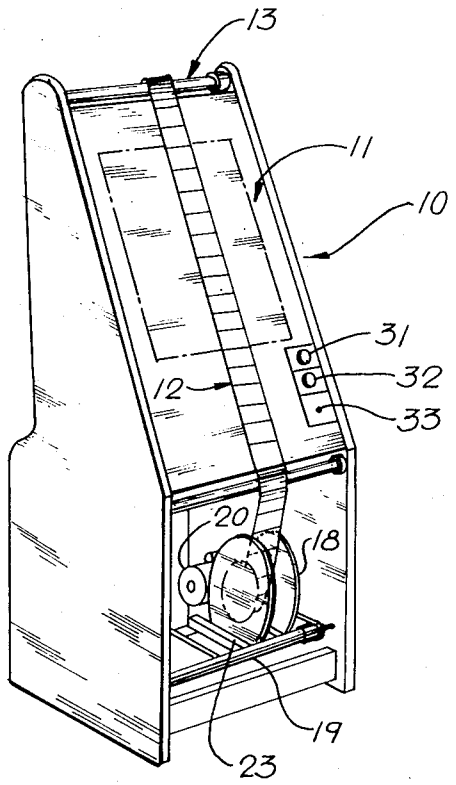
FIG. 1 is a front perspective view of an inspection machine according to the present invention.

Referring to FIGS. 1 and 2, as print strip 12 travels across viewing panel 11, it is collected in a take-up reel 18 which rests freely upon parallel spaced rollers 19,19 driven by a motor 20 below panel 11. The motor-driven rollers 19 frictionally drive take-up reel 18 resulting in winding of strip 12 onto reel 18, provided the strip is being advanced from the supply reel 15 by operation of the strip advancing capstan means 13.

It should be noted that the motor driven take-up apparatus as depicted in FIGS. 1–4 operates independently of the motor-driven capstan means 13. When capstan drive motor 21 is turned off so strip 12 is not being advanced over the viewing area 11, then take-up reel 18 will no longer turn at the urging of motor-driven rollers 19 since reel 18 will be prevented from turning by the resistance of the nonadvancing print strip, even though rollers 19,19 will continue to rotate. Print-winding or take-up action of reel 18 will be reinstated when the motor-driven capstan means 13 resumes operation to advance the strip 12 over the viewing surface 11.

Figure 4:
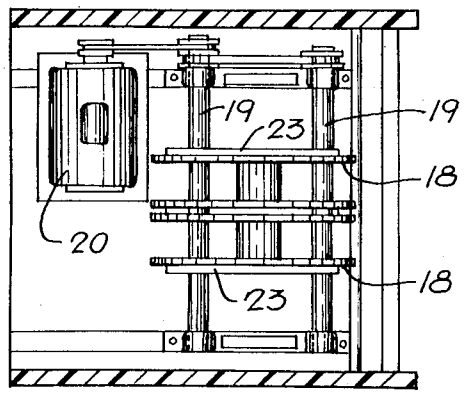
FIG. 4 is a cross sectional view taken substantially along vantage line 4—4 of FIG. 3 and looking in the direction of the arrows thereon.

As shown in FIGS. 2 and 4, the machine can accomodate a plurality of supply reels 15 and take-up reels 18; reels 15 and 18 being separated from adjacent reels by intervening dividers 22 and 23, respectively.

As a strip 12 advances across viewing area 11, a technician-operator visually inspects the individual photos, but frequently may be required to mark individual defective prints. Such a requirement is facilitated by the control system depicted in FIG. 5 which permits the operator automatically to arrest movement of a photo strip 12 by merely placing his hand near the viewing area 11 in strip marking position. Conversely strip movement is reinstated by removal of the operator's hand.

Figure 5:
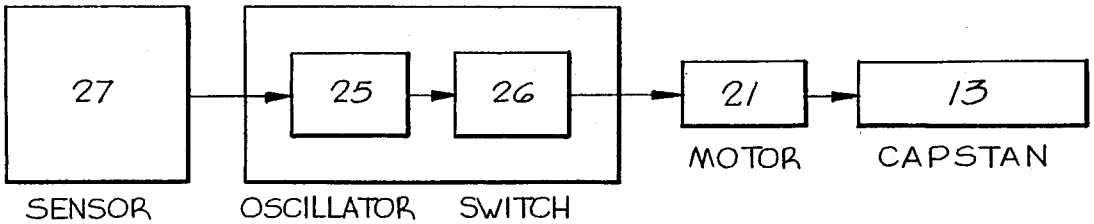
FIG. 5 is a schematic block diagram representing the antenna and presence switch means employed in the machine of FIGS. 1–4.

According to this invention the above noted selected interruption and reinitiation of photo strip movement is carried out in general by controlling operation of capstan motor 21 and its associated capstan means 13 as schematically represented in FIG. 5 of the drawings. As there indicated, control of capstan motor 21 preferably is accomplished by use of presence switch means 26 employing oscillator means 25 and a capacitance reactive sensor or sensing antenna 27. Switch means 26 may embody any of a number of known presence switch circuits made up of a standard array of components available from catalog or supply houses. Typical of such prior known switch circuits capable of providing presence switch means according to this invention is the "intrusion alarm" circuit published in *Sourcebook of Electronic Circuits,* John Markus, McGraw Hill Book Company, N.Y. 1968, p. 87 or the "body-capacitance alarm" circuit appearing on page 88 thereof. Other known capacitance operated circuits are likewise available for this purpose within the skill of the art. The electrically conductive sensor or antenna 27 is responsive to the conductivity and more particularly the impedance of the operator's body for controlling operation of switch means 26 which is triggered by the presence of the operator's hand near sensor or antenna 27 to deenergize motor 21. When the operator's hand is withdrawn from near the antenna, capstan motor 21 is reenergized.

Sensor or antenna 27 is an electrically conductive metal plate, illustrated in FIG. 5, which is physically located on the rear of the viewing surface panel 11, as best shown in FIG. 2 of the drawings. The machine 10 is further equipped with a control box 30 (see FIGS. 1 and 2) having an operating dial 31 available on the front of panel 11. Dial 31 is used to make fine adjustments in the sensitivity of the antenna. A second adjustment dial 32 is also provided which controls the motor speed of capstan motor 21 and an on/off switch 33 is provided to control line supply to the machine.

The presence of an operator's hand or other external impedance within a sensing distance of approximately 4 inches from the sensor or antenna 27 serves to load the plate antenna and activate the presence switch means 26 to interrupt operation of the capstan drive motor 21 as above explained. Conversely withdrawal of the operator's hand or external impedance restores the system to its original web advancing mode of operation.

While the present invention has been described as it relates to photo inspection, it is fully contemplated that the principle and teachings thereof may be employed in the inspection of web-like materials other than photo prints without departing from the spirit and scope of this invention.

I claim:

1. An apparatus for hand-marking an elongated strip of photographic prints or other web-like material as it is moved across the visual field of the operator, including in combination:

means defining a viewing area across which the strip may be moved for operator-inspection and selected marking when movement thereof is arrested, first means operative when energized to move the strip lengthwise over said area in substantially continuous motion, thereby permitting the operator to inspect the same visually, an electrically conductive element generally coextensive with said area, such that the strip is interposed between the operator's view and said element, electrical switch means in circuit with said element and first means and operatively responsive to the presence of the operator's hand in marking position relative to the strip and element to deenergize said first means and arrest motion of said strip, whereby the operator need only move his hand to strip-marking position upon observing a point to be marked on the strip and movement of the strip is thereby arrested to permit convenient, error-free marking thereof.

2. An apparatus for examining a continuous web or strip as it is moved across the visual field of a human viewer, comprising:

first means defining a surface over which the strip may be moved for examination, second means operative when energized to move the strip lengthwise over said surface with substantially continuous motion, thereby permitting said viewer to examine the same visually, third means defining an electrically conductive capacitance reactive sensor adjacent said viewing surface, and presence switch means in circuit with said sensor and second means and operatively responsive to the presence of external impedance, such as said viewer's hand, in proximity to said sensor, to deenergize said second means and arrest movement of said strip, whereby said viewer may work on the arrested strip.

* * * * *